United States Patent [19]

Valtolina et al.

[11] Patent Number: 4,728,310

[45] Date of Patent: Mar. 1, 1988

[54] TOY CONSTRUCTION DEVICE

[76] Inventors: Costante Valtolina, Via Don Marzorati, 2, 221047 Saronno (Varese); Marco Velati, Via Tortona, 72, 20144 Milan, both of Italy

[21] Appl. No.: 824,347

[22] Filed: Jan. 23, 1986

[51] Int. Cl.[4] ..... A63H 33/08

[52] U.S. Cl. ..... 446/111; 446/118; 446/128; 52/584

[58] Field of Search ..... 446/111, 112, 115, 118, 446/128, 85, 124, 108, 113, 114; 52/584, 578, 581, 585

[56] References Cited

U.S. PATENT DOCUMENTS 3,867,784 2/1975 Lange ..... 446/128

4,077,154 3/1978 Muller ..... 446/128

FOREIGN PATENT DOCUMENTS 890608 3/1962 Canada ..... 446/128

22237 7/1981 Italy .

*Primary Examiner*—Mickey Yu

*Attorney, Agent, or Firm*—Sughrue, Mion, Zinn, Macpeak & Seas

[57] ABSTRACT

A structure for assembling a toy is disclosed wherein a flat plate contains modular units defined by parallel and perpendicularly spaced ribs. Connection elements have pins extending from both faces and are frictionally fitted into the modular units to join the plates and construct toy structures.

3 Claims, 6 Drawing Figures

FIG. 1
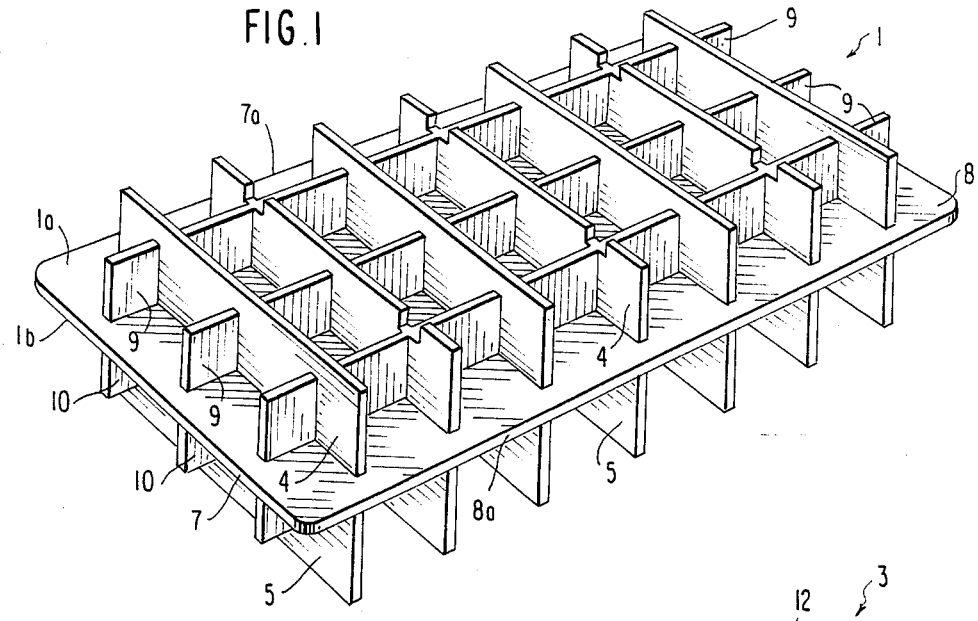
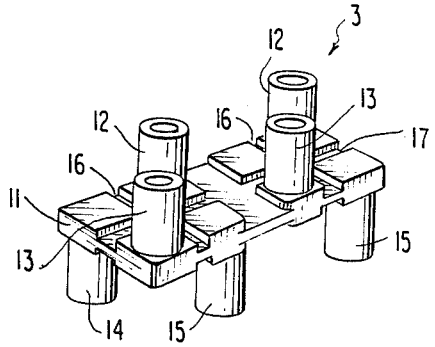
FIG. 3
FIG. 2
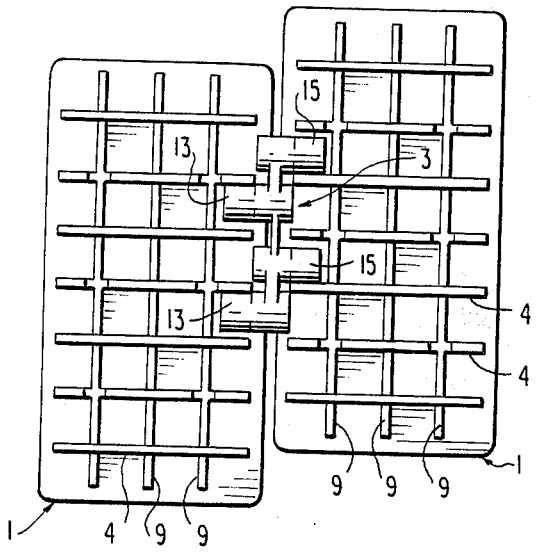
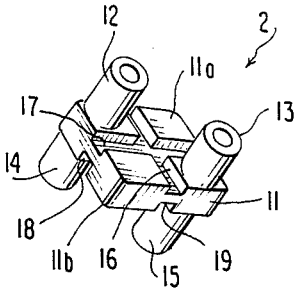
FIG. 4

TOY CONSTRUCTION DEVICE

BACKGROUND OF THE INVENTION

The present invention relates to a construction for frictionally fitting components together to make a toy assembly; the basic elements are a flat, ribbed plate and at least one connection element fitted on at least one face with a couple of projecting pins. Both the connection element and the plate are structurally independent and are frictionally fitted together.

In detail, the present invention is an improved version of the one described in the patent application for Utility Model number 22237 B/81 filed on July 1st, 1981 by Costante Valtolina and Marco Velati, whose content is enclosed herewith as a reference.

The interlocking elements described in the above mentioned patent application are rod-like elements having a cross-section substantially in the shape of an "E", and other elements which comprise a plate, The plate having on at least one of its faces, one pair of cylindrical pins which are capable of being arranged in an astride fasion on top of the central spine of the rod-like elements.

However advantageous such a structure may be from many points of view, it has some application limits, particularly when it is required to couple several rod-like elements together. In this case it would be necessary to use some more connection pieces arranged in an astride fashion towards the rod-like elements which would detract from the architecture of the toy structure.

SUMMARY OF THE INVENTION

An objective of the present invention is to create a structure of mutually interlocking coupling elements to build toy structures having functional and structural features which will overcome the inconvenience ensued with reference to the prvious technique and be particularly capable of coupling the elements in a various number of relative positions to facilitate the building of complex structures.

This objective is achieved through interlocking element structure according to the present invention which comprises a ribbed plate and at least a plate-shaped connection element fitted on at least one face with a plurality of pins. Both the connection element and the plate are structurally independent and can be frictionally fitted together. This invention is characterized by the fact that the plate has at least one face with several parallel and perpendicularly spaced ribs.

The characteristics and the advantages of the invention will appear more clearly from the following detailed description of an ideal form of realization, which is only indicative and non-restrictive and is illustrated in the enclosed drawings.

DESCRIPTION OF THE DRAWINGS

FIG. 1 is a perspective view of a plate having a structure according to the invention;

FIG. 2 is a planar view of a couple of plates of the structure coupled side by side through a connection element according to the invention;

FIGS. 3–4 are a perspective view of connection elements of the structure according to the invention.

DESCRIPTION OF THE EMBODIMENTS

Figure 5:
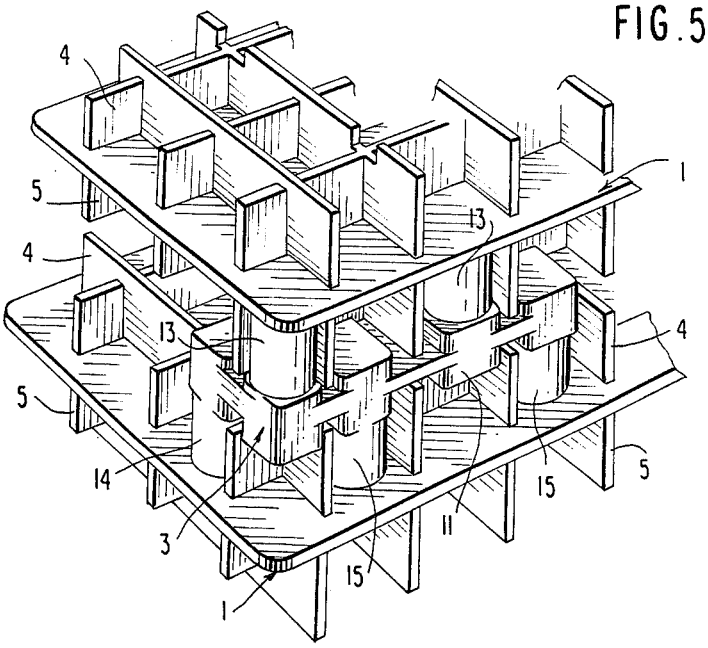
FIGS. 5–6 are examples of plate connections of preferred structure according to the invention.
Figure 6:
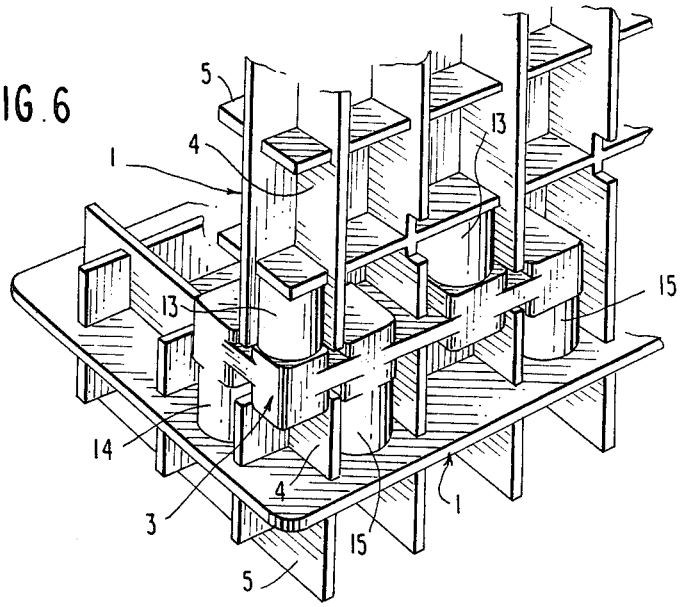

With reference to the above-mentioned figures, the structural interlocking elements for the realization of toy structures, according to the invention, comprises a plate 1 of a fixed limited thickness as well as a single connection element 2 (FIG. 4) and a double connection element 3 (FIG. 2–3) designed to be interlocked with said plate 1.

Plate 1 is provided, on opposite sides 1*a* and 1*b*, with a plurality of ribs 4, 5, secured to the plate and disposed parallel to one another.

According to the invention, the plate is four-sided (e.g. rectangular or square) and the ribs 4, 5, are equally spaced from each other and are placed along the entire length or width of the plate 1 from one side 7 to the other side 8.

The plate 1 is also provided with a plurality of ribs 9, 10, perpendicular to the ribs 4, 5 previously considered. These ribs 9, 10 are modularly spaced among them on the faces 1*a*, 1*b* of the plate 1. The ribs follow a constant pitch equal to the modular space of the ribs 4, 5 with which they form, on each of the faces 1*a*, 1*b*, a square mesh grill configuration of modular units.

With particular reference to FIG. 4, a single connection element 2 is formed by a square plate element 11, provided on each of the opposite faces 11*a*, 11*b* with a pair of pins 12, 13, 14 and 15 disposed on opposite corners of the plate faces.

On each said face 11*a*, 11*b*, there is a pair of incisions 16, 17, 18, 19 crossing each other perpendicularly in a cruciform shape and tangential to the respective pairs of pins 12, 13, 14 and 15. These incisions divide the face into four equal quadrants.

FIG. 3 illustrates a double connection element 3 and its constructive details are similar to those of the single connection element 2 and are specified with the same reference numbers. Unlike the junction element 2, pins of the junction element 3 are extended from the opposite sides in a 90° staggered position. The thickness of the plate elements that form the junction elements 2, 3 are of a pre-established value and the incisions 16–19 have a depth which equals the thickness of plate 1.

From a geometrical point of view hereafter, some basic characteristics of the invention will be shown.

We must note in fact that the distance of the ribs 4, 5 from the corresponding sides 7, 8 of the plate 1 is equal to the modular distance beween the ribs, minus one half the thickness of the junction elements 2 or 3 with the thickness being the distance between the faces 11*a* and 11*b* of the connection plate.

In this case, it is in fact possible to keep the required distance between the ribs 4, 5 of two different plates 1 connected together side by side, orthogonally to the considered ribs (FIG. 2).

Likewise and for the same reason, the ending ribs 9, 10 are spaced from the respective sides 7*a*, 8*a* of the plate 1 of a pitch equal to the modular distance minus one half the thickness of the joint elements 2 or 3.

The height of the ribs 4, 5 and 9, 10 can be equal but preferably one set of ribs has a height greater than the other set of ribs. One reason is to enable the plate to be easily removed from the mold, and a second reason will be discussed below.

The coupling between connection elements takes place because of elastic deformation of the ribs of the plate by the pins. By providing a greater height in one set of ribs, these ribs will extend into the incisions on the connection elements and help maintain the connection elements in the proper alignment.

The invention reaches the earlier discussed objectives and obtains several other advantages such as a special constructive simplicity and a remarkable versatility of application to obtain the most disparate coupling configurations and to make easier the building of very complicated toy constructions.

What is claimed is:

1. A toy construction device comprising, in combination:

a flat plate having two sets of resilient ribs arranged on each side of said plate, a first set of ribs being arranged parallel with one another, having an equal pitch therebetween and spaced substantially across the entire plate, a second set of ribs also being arranged parallel to each other, having an equal pitch therebetween and spaced substantially across the entire plate in a direction perpendicular to the direction of said first set of ribs, both first and second sets of ribs being integrally formed on said plate and defining a plurality of modular units wherein one set of ribs has a greater height than said other set of ribs; and a connection element for frictionally fitting in said modular units for connecting a plurality of said plates, said connection element comprising a connection plate having oppositely disposed faces, orthogonally disposed incisions on at least one face of said connection plate and each face having rigid pins extending perpendicularly therefrom for a frictional fit within said modualr units, wherein said flat plates are connected together by inserting said pins of the connection element into said modular units of the flat plates to be connected and said ribs defining said modular units are elastically deformed by said pins and said set of ribs having the greater height are disposed in said incisions when said pins are secured in said modular units.

2. A toy construction device as recited in claim 1, wherein said connection plate is square shaped and has two pins extending from opposite corners of each said face, said corners being the same on each said face.

3. A toy construction device as recited in claim 1, wherein said connection plate is rectangularly shaped by having two square portions interconnected, each said square portion having two pins extending from opposite corners of each said face, said corners being different on opposite faces of the same square portion.

* * * * *